United States Patent [19]

Matsuyama et al.

[11] 4,016,329

[45] Apr. 5, 1977

[54] MULTIFILAMENT

[75] Inventors: Mitsuyoshi Matsuyama; Tetsuhiro Kusunose, both of Nobeoka, Japan

[73] Assignee: Asahi Kasei Kogyo Kabushiki Kaisha, Osaka, Japan

[22] Filed: Jan. 29, 1975

[21] Appl. No.: 545,167

Related U.S. Application Data

[63] Continuation of Ser. No. 299,621, Oct. 11, 1972, abandoned.

[30] Foreign Application Priority Data

Oct. 11, 1971 Japan ..... 46-79457
July 27, 1972 Japan ..... 47-87880

[52] U.S. Cl. ..... 428/375; 156/180; 264/177 F; 428/364; 428/296; 428/399; 428/395

[51] Int. Cl.[2] ..... D02G 3/00

[58] Field of Search ..... 428/370, 397, 399, 400, 428/401, 296; 156/180, 296, 166; 264/176 F, 177 F, 174

[56] References Cited

UNITED STATES PATENTS

| | | | |
|---|---|---|---|
| 3,185,613 | 5/1965 | Adams | 428/399 |
| 3,251,181 | 5/1966 | Breen et al. | 428/395 |
| 3,388,030 | 6/1968 | Estes | 156/180 |
| 3,439,084 | 4/1969 | Ono et al. | 264/176 F |
| 3,439,489 | 4/1969 | Holton et al. | 428/401 |
| 3,470,685 | 10/1969 | Hall et al. | 428/397 |
| 3,634,163 | 1/1972 | Lamb et al. | 156/166 |
| 3,671,381 | 6/1972 | Hansen | 428/401 |
| 3,777,470 | 12/1973 | Suzuki et al. | 156/296 |

*Primary Examiner*—George F. Lesmes
*Assistant Examiner*—P. J. Thibodeau
*Attorney, Agent, or Firm*—Armstrong, Nikaido & Marmelstein

[57] ABSTRACT

This invention relates to an improved multifilament bundle which is made of thermoplastic polymer and usable without twisting and represents a linen-like touch. The multifilament bundle comprises a plurality of monofilaments of the same kind of thermoplastic polymer, said monofilaments being bonded thermally and partially together with neighboring at separated places thereof, each of said bonded places extending short distance along and in the longitudinal direction of monofilament, so as to make the constituent monofilaments coherent with each other into a non-torqued, non-bulky continuous yarn. This yarn can be fabricated, without sizing, into a textile fabric. This yarn can be used in various fields requiring untwisted yarns including sewing machine yarn. This yarn can be manufactured by passing a multifilament as spun at underfeed condition through a passage zone where heated fluid flows are brought into collision with each other. The fluid may preferably steam, while the material polymer may preferably 6- or 66 nylon.

1 Claim, 15 Drawing Figures

FIG. 3(III)
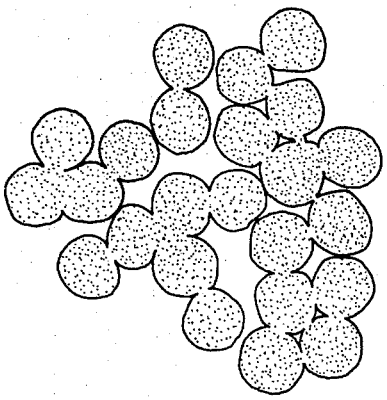

FIG. 12(III)
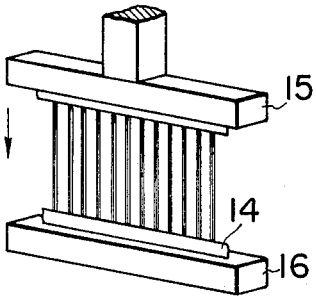

MULTIFILAMENT

This application is a continuation application of application Ser. No. 299,621, filed Oct. 11, 1972, now abandoned.

This invention relates to an improved multifilament yarn composed of a plurality of monofilaments bundled together and representing a linen-like touch.

Multifilaments yarns of synthetic polymer or copolymer have found their broad use in the field of textile fabrics or the like for human clothes and industrial materials over natural fibers and regenerated fibers. Although synthetic fibers represents superior characteristics, especially various mechanical properties over natural and regenerated fibers they are still defective on accounts of their waxy feeling and touch, as well as loss of resiliency. Especially in the case of multifilamant yarns, these waxiness and unresiliency are highly desired to improve.

The multifilament yarn consists naturally of a plurality of monofilaments and they are fabricated into threads, fabrics and/or various secondary textile products by consuming manufactures. In this case, the most important and basic characteristic of this kind of yarn to be desired as delivered to the consuming manufacturer is the coherency of the constituent monofilaments. With the multifilament yarn of insufficient coherency, when it is processed on weaving-, knitting-, twisting-, winding and/or texturing machine, the filaments coherency will become the more loosened by sliding contact with yarn guides on these machines, thereby not only the processing efficiency becoming the more worse, but also the acceptability and quality of the adversely affected so far.

The most generally adopted conventional measure for attaining filaments coherency resides in the twisting and/or sizing techniques. Although for carrying out these coherency-providing steps, considerable amount of initial investment and labor costs must be consumed, these steps could not be dispensed with, if generally speaking, and for guaranteeing the desired best quality of the processed products and the optimum processing efficiency.

As an example, when considering the twisting technique, it will invite modification of the original feeling, touch and rigidity owned by the multifilaments, thereby limiting generally and substantially the utility. In certain specific utilization field such as for use as sewing yarns, the twist is generally deemed as unfavorable. It is also highly desired to provide multifilament yarns non-twisted and non-sized in the fields of use thereof requiring no crimps, no bulkiness and no stretchability.

Various proposals have been made for providing coherency in the multifilament yarn of synthetic fibers, by reliance of other means than sizing and/or twisting. According to a prior proposal, an adhesive oil is applied to the multifilament as being spun out. According to a further prior proposal, the filaments are mechanically and irregularly cross-linked together. According to a still further proposal, the filaments are partially and repeatedly bonded together.

A still further prior proposal is disclosed in Japanese Patent Publication No. 12236/1961 that a multifilament is passed through a turbulent flow zone of a gaseous medium, thereby preparing a yarn of mechanically cross-linked filaments of non-bulky nature adapted for use in the manufacture of a textile fabric. This kind of coherent multifilament yarn dispenses with conventional sizing step during the manufacture of a textile fabric therefrom.

Still another prior proposal is disclosed in U.S. Pat. No. 3,251,181 that the constituent monofilaments of a multifilament yarn are partially bonded together separately and infinitesimal places along the whole length of each of the filaments, thereby providing a bulky and stretchable yarn, the coherency thereof being realized by the action of a fluid flow.

According to a still further prior proposal, a polyamide including a polyalkylene ether compound is melt spun under a specifically selected condition, so as to bond a plurality of monofilaments locally together for providing a so-called polyamide multifilament yarn.

These coherent yarns is characterized by dispensing with conventional sizing and/or twisting steps in their practical usage, thus representing a substantial progress in the art. In the case of the mechanically cross-linked yarn prepared in accordance with the prior proposal disclosed in Japanese Patent Publication No. 12230/1961, not only loss of smoothness of the yarn is encountered, but also, there is no possibility of intentional removal of the waxiness inherent in the synthetic fiber yarn.

On the other hand, the partially and locally bonded crimped yarn as prepared in accordance with the prior teachings disclosed in U. S. Pat. No. 3,251,181 has been found as unusable in such field as requiring the resiliency of the yarn. Although this kind of yarn represents locally bonded places of the constituent filaments, its bending resistance is not improved. The yarn frequently main contain two or more differently melting polymer filaments, preferably in a conjugated composite manner, resulting frequency in uneven dyeing and other disadvantageous properties.

In consideration of the aforementioned facts in the conventional techniques, the present invention has its object to provide a multifilament yarn which represents substantially improved smoothness, bending regidity and mechanical feeling.

A further object is to provide a multifilament yarn having a linen-like touch.

A still further object of the invention is to provide a multifilament of the above kind, yet being well coherent, substantially non-bulky, non-stretchable and non-twisted, and usable without sizing and/or twisting.

A still another object is to provide a multifilament yarn which can be utilized as per se in the field where non-twisted yarn is highly desired, such as the sewing machine yarn.

It is further object of the present invention to provide a process for the manufacture of the above kind of multifilament yarn while utilizing a heated fluid medium, preferably steam.

A still further object of the present invention is to provide an apparatus adapted for the manufacture of the above kind of multifilament yarn.

The multifilament yarn according to this invention comprises a plurality of constituent monofilaments of one kind of thermoplastic artificial substance and bonded partially and locally together, substantially non-torqued and non-bulked, having a linen-like touch each of the locally bonded area having an axially longer dimension than lateral dimension thereof, each of said monofilaments having an overall distribution of ripple-like undulations when observed on an electromicroscope, said monofilaments being intertwined substantially in no way.

The above kind novel multifilament yarn can be manufactured in such a way that a plurality of monofilaments of one and the same kind of thermoplastic polymer or copolymer as melt spun is passed at an underfeed speed through a limited passage where a heated fluid flows are constantly brought into collision with each other before being led to an open atmosphere.

These and further objects, features and advantages of the present invention will become more apparent when read the following detailed description of the invention to be set forth by reference to the accompanying drawings.

Figure 1:
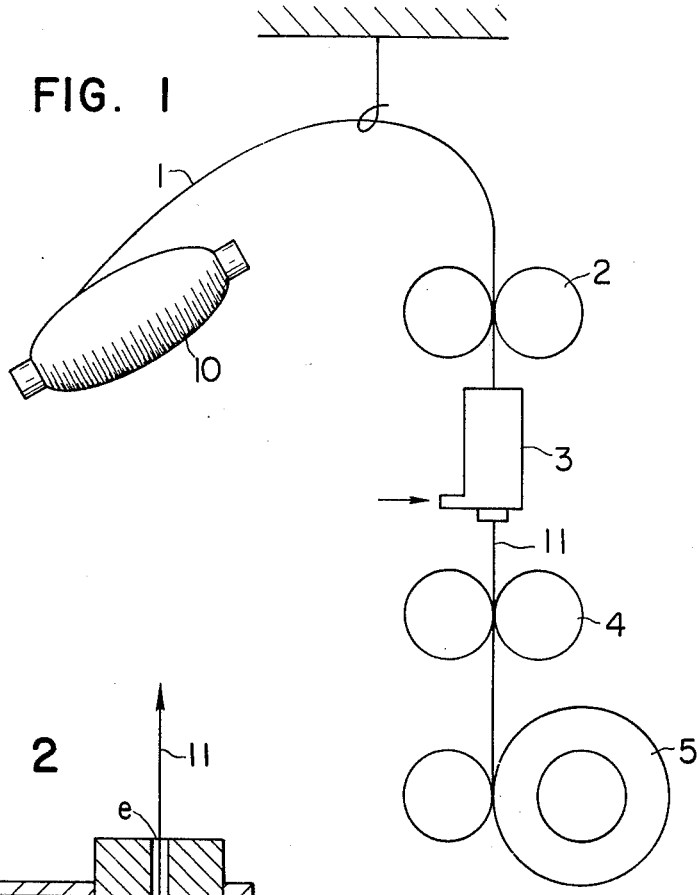
FIG. 1 is a schematic illustrative sketch for the illustration of the process of the manufacture of the multifilament yarn according to this invention.

The inventive multifilament yarn is made of a thermoplastic synthetic polymer or copolymer, such as polyamide, polyester, polyethylene, polypropylene, polyurethane, polyvinyl alcohol, polyvinyl chloride, polyvinylidene chloride or the like. Among others, polyamide is highly suitable in the practice of the invention. The softening point of polyamide polymer becomes substantially lower in the presence of aqueous gas medium. As an example, nylon 6 melts at 220° C, but is begins to soften from 130° C in the presence of heated steam, the softening point being lower by 90° C or so than the melting point. It can be, therefore, melt-bonded in a highly stabilized way and almost instantly (generally less than 0.1 second) without invitation of deterioration in the physical properties of the material, and indeed, by effective utilization of the above phenomenon. By reason of this, polyamide such as nylon 6 or nylon 66 is highly suitable for the practice of the present invention.

For better understanding, a preferred embodiment of the process for the manufacture of the multifilament yarn according to this invention will be described in detail by reference of FIG. 1.

In this figure, numeral 1 denotes a spun and stretched multifilament which is supplied from a supply origin, as represented schematically in the form of a cheese 10, through a pair of engaging feed rolls 2 to a processing head 3 made in the form of a nozzle unit. At the outlet of this head 3, wherein it is processed into a processed multifilament yarn according to this invention. This yarn 11 is then taken up by a pair of engaging delivery rolls 4 and finally wound up on a winder 5.

Figure 2:
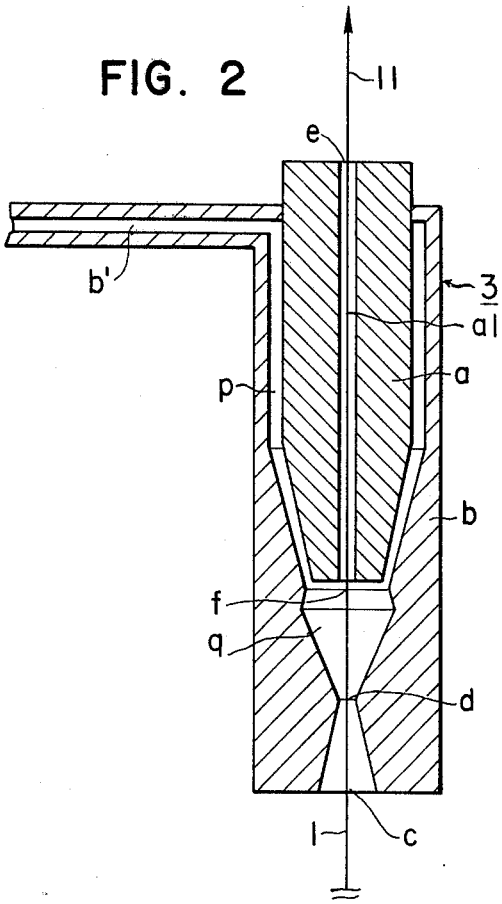
FIG. 2 is an axial section is usable for carrying out the manufacture of the improved multifilament yarn according to this invention.

The processing head 3 is more specifically shown in FIG. 2. In this figure, wherein the head 3 is up-and-down invertedly shown only for convenience, and for showing the non-directional applicability thereof.

The raw material multifilament 1 is being fed from below to the head 3 which comprises a centrally bored yarn guide piece *a* which is coupled concentrically with a sheath member *b*, the central yarn guide passage bore, having a diameter generally from 0.1 – 5 mm in the guide piece *a* being shown at al Symbol *b'* represents a supply piping for a certain heated fluid medium, preferably heated steam, from a certain supply source, not shown, preferably a reservoir or boiler; *c* denotes an inlet opening formed within the material of sheath member *b*, extending concentrically and axially thereof. A throttling throat *d* is provided at an intermediate point along the inlet opening *c*, said throat having a reduced diameter, preferably 0.1 – 5 mm. The innermost part, shown at *q*, of the inlet opening *c* constituents an inwardly enlarged, tapered chamber which constituents a fluid flow collision space, as will be more fully described hereinbelow.

The heated fluid, preferably heated steam, is led from the supply piping *b'* through a ring gap space *p* formed between guide piece *a* and sheath member *b*, into the space *q* where the fluid flows are brought into collision against each other. *f* denotes an inner or inlet end of the guide bore *al*, while *e* represents an outer or outlet end thereof. The gap passage *p* is designed so as to have a least lateral dimension of 1.2 mm in the present embodiment.

Figure 4:
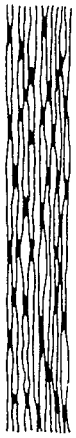
FIG. 4 is a schematic and enlarged plan view of the multifilament yarn according to this invention.

The processing head 3 has an outlet appearance somewhat resemble to a Taslan processing unit, but, its true operational function is highly different therefrom. More specifically, the heated fluid arrived at the space *p* defined partially by and between the reduced throat *d* and inlet *f* to the guide bore *al* is subjected to a substantial outgoing resistance, thus kept in its compressed state and in constant and mutual flow collision. In this space *q*, the introduced and travelling multifilament through this space from below to upper in FIG. 2, being acted upon by the heated fluid kept in compressed and flow-colliding state. After completion of such processing contact with the multifilament 1, the fluid is then discharged from the both end openings *c* and *e* after dividedly and oppositely flowing through the opening and the guide bore, into the open atmosphere. In this case, it should be noted that the multifilament yarn 1 is passed through the processing head 3 under underfeed condition, thereby the yarn being heated through contact with the aforementioned high temperature, high pressure fluid prevailing in the chamber *q* up to a temperature above the softening point of the filamentary polymer, so as to bond locally and partially the monofilaments with each other and in a repeated manner, as schematically illustrated in FIG. 4 wherein a number of black dashes represent such bonds appearing among the constituent monofilaments. The outlet yarn as processed completely in accordance with the present invention is shown at 11 in FIGS. 1 and 2.

The in-feed of the stretched multifilament yarn 1 may be performed from a wound bobbin thereof. However, rather more preferably, the multifilament yarn as appearing at the delivery side of a yarn stretching unit may be utilized for the above in-feed purpose.

In place of the stretched multifilament yarn as shown only schematically at 1 in FIGS. 1 and 2, unstretched yarn of the similar kind as above can be utilized when necessary. In this case, however, caution should be direct to such fact when the unstretched and processed yarn is subjected to stretching in a later step, the locally and partially bonded areas may be unintentionally reseparated. It is thus necessary to process the unstretched multifilament so as to intensifying substantially the filament bond. As was referred to hereinbefore, the material yarn feed from the feed roll pair 2 to the delivery roll pair 4 is made under underfeed conditons. With use of stretched material yarn, the underfeed rate may be less than 10%, and preferably in the range of 5 – 8%. With larger underfeed rate than 10%, the degree of local filament bonding may decrease to an unacceptable degree according to the results of our practical experiments.

According to our knowledge, the processing head as shown by way of example in FIG. 2, must have a pair of opposing outlets for the processed steam, in order to establish in effect a fluid stream collision chamber at *q*, and for the preparation of the processed multifilament yarn according to the present invention. Now assuming that each of the inside diameters at *al* and *d* has been selected to 0.1 – 5 mm, the processed steam may escape in one way and through the outlet at *c* only, if the gap dimension at *h* be less than 1.2 mm. In the latter case, the processing head 3 will provide only the effects similar to those known as Taslan effects adapted for the manufacture of bulky yarn. The difference between the both is believed by us that the establishment of the two way steam outlets and the formation of the steam flows collision chamber *q* at an intermediate between the both steam outlets.

By dimensioning each of the inner diameters of guide sleeve *a* at *al* and at the reduced throat *d* to less than 0.1 mm, a statically compression chamber will be formed at *q*, but the processing fluid passage rate will become unacceptably small. In order to attain the inventive effects on the processing multifilament yarn, the following two conditions must be maintained. At first, the establishment of a dynamic compression chamber at *q* where the fluid flows are brought into collision against each other. Secondly, a substantial degree of flow rate of the processing heated fluid such as steam must be maintained. In place of the heated steam employed in the foregoing, heated gaseous medium such as hot air can be introduced into the processing head 3.

The injective introduction of the heated fluid into the processing head 3 is very difficult to maintain it at its generally steady condition, resulting in substantial fluctuation in the dyeing properties and various physical characteristics owned by the processed multifilament yarn. We have found, however, upon execution of various and profound practical experiments that when the aforementioned processing step by use of heated fluid is executed simultaneously with the filament stretching step, the aforementioned disadvantageous fluctuations can be substantially avoided favorably for the purpose of the invention. By adopting the last mentioned technique to jointly executed the aforementioned both steps, the manufacture of the partially and locally bonded, non-twisted multifilament yarn ready for practical use can be performed in a highly easy, economical and efficient way.

Figure 3I:
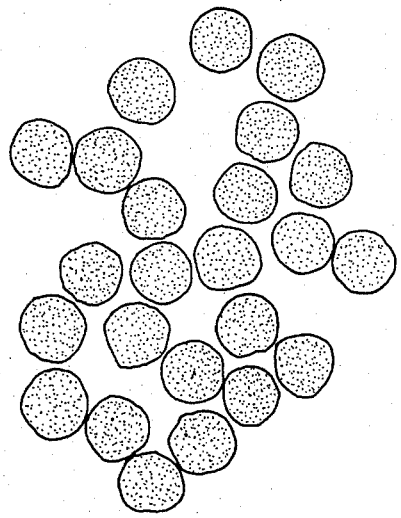
FIG. 3 represents two enlarged cross-sections of a conventional multifilament in comparison with two those of the multifilament according to this invention.
Figure 3:
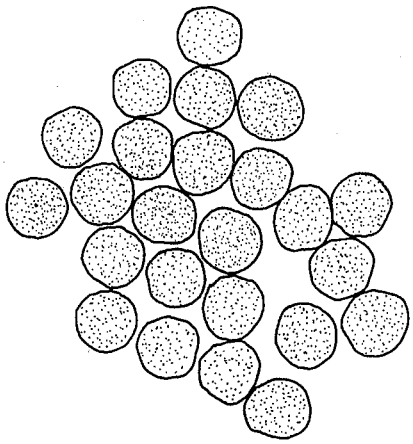
Figure 3:
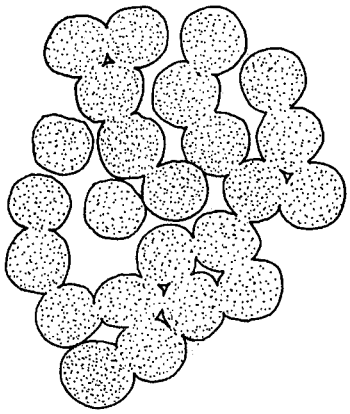

In FIG. 3 at (I) and (II), two cross-sectional views of conventional multifilament yarn are shown in a highly enlarged and schematic way. As seen, this kind of yarn does represent substantially no local filament bonds.

In FIG. 3, at (III) and (IV), two comparative cross sections of a sample yarn of the present invention are shown for comparison with the above. Local and partial filaments bonds formed to an appreciable degree are seen and any person skilled in the art may easily see that the multifilament yarn representing such intimate and frequent formation of local filament bonds will guarantee the readiness of the yarn for practical use without application of yarn twists.

Figure 5:
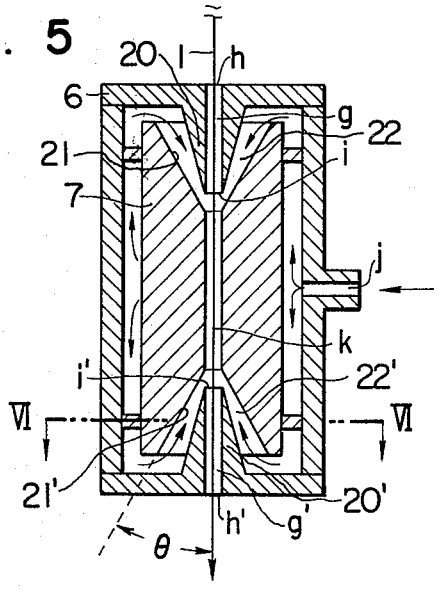
FIG. 5 is a longitudinal section of a nozzle means usable in the present invention.
Figure 6:
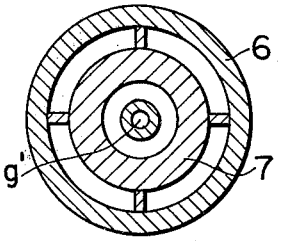
FIG. 6 is a cross-section thereof.

An embodiment of a modified processing head is shown in combination in FIGS. 5 and 6. This head comprises an outer hollow cylinder 6 and inner cylinder 7 concentrically arranged thereto and rigidly coupled therewith as seen. The outer cylinder 6 is formed with axially and inwardly projecting cones 20 and 20' which are formed in turn with respective yarn guide passages *g* and *g'*, axially extending in line with each other. These passages *g* and *g'*, terminate into outlets *h* and *h'*, respectively, opening at the open atmosphere. The inner extremities of these passages are shown at *i* and *i'*, respectively. A laterally extending inlet *j* is provided through the wall of the outer cylinder 6 at the middle heights thereof.

The inner cylinder 7 is formed with coned recesses 21 and 21' centrally and axially in the both end surfaces. The male cone 20 or 20' is substantially in opposition to the female cone 21 or 21', respectively, yet the former having a smaller cone angle than the latter, for the purpose of attaining a certain degree of fluid convergence. Each of the passages *g* and *g'* opens inwardly at the apex of the male cone 20 or 20', respectively, at *i* or *i'*. The inner cylinder 7 is formed with a centrally and axially extending passage *k* which opens outwardly at its both ends and at the respective bottoms of the female cones 21 and 21'. As seen, these passages *g*, *k*, and *g'* are arranged in line one after another. The half of the cone apex angle, being denoted with $\theta$ in FIG. 5, is to be selected to less than 45°. The heated processing fluid, preferably steam, is led through inlet *j* and thence through coned gaps 22 and 22' in opposite directions to each other, as schematically illustrated in FIG. 5 by a plurality of small arrows, and into the central passage bore *k* which constitutes, in effect, a fluid flows collision space, because the fluid counter flows are brought into collision within this central passage *k*. It will be easily understood that the fluid compression and -collision effects in this modified processing head shown in FIG. 5 are superior over the foregoing embodiment shown in FIG. 2. When the each of the passages *g* and *g'* has a length longer than ten times the respective bore size, the desired effect can be still further improved. The bore size at *g* and *g'* may preferably be 0.1 – 5 mm. By observing these conditions, it was ascertained that the processing efficiency could be raised to about a doubled value or still higher in comparison with the processing head shown in FIG. 2.

In the processed multifilament yarn according to this invention, the constituent monofilaments extend substantially in the extending direction of the yarn, thus practically no appreciable interfilamentary cross-linkages even when compared with conventional least twisted, false twisted multifilament yarns.

Figure 7:
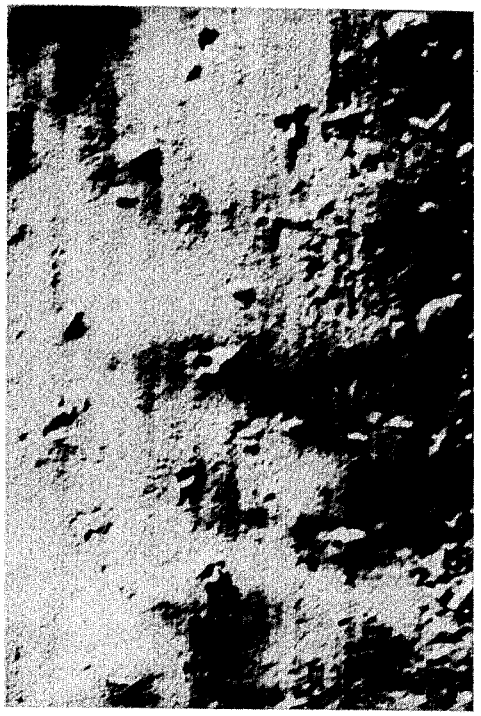
FIGS. 7 and 8 are respective reproductions of electromicroscope views of monofilament of conventional and inventive multifilaments, taken by the reprica process on a penetration type electron microscope, the magnifying factor being × 20,000 × 1.5.
Figure 8:
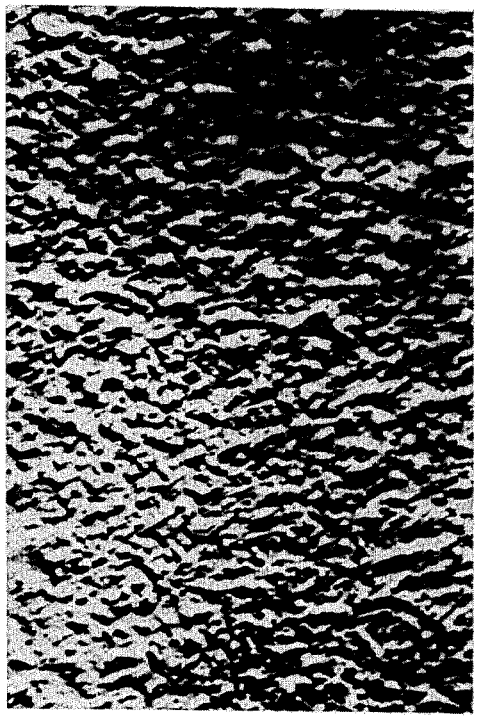

In FIG. 7, a general appearance of a conventional monofilament of an unprocessed multifilament yarn is shown as appearing on an electron microscope at a magnifying factor in the order of 20,000 times, being prepared by the reprica process. As seen, the surface of the filament represents a waxy touch and is substantially smooth and glazy. On the other hand, that of the simliar monofilament, yet having been processed in accordance with the novel teachings of the present invention represents a large number of fine and ripple-like undulations distributed substantially evenly over the whole peripheral surface of the filament, thus losing its waxy and smooth surface touch and representing a linen-like feeling. When observing microscopically several parallel monofilaments, substantially no physical cross-linkages could be observed. Therefore, the processed multifilament yarns have their various vast and valuable usages in various different industries, requiring non-twisted yarns for smooth and high speed supply and guidance thereof. These improved yarns are highly valuable, for instance, as sewing machine yarns and those for knitting of human sweaters and the like textile knitted goods.

As a representative example of the improved multifilament yarn, and as the results when observed it on an electron microscope, it has been determined that the aforementioned very fine undulations have generally their mean height or depth in the order of $2.5 - 25 \times 10^{-5}$ mm and the number of the fine ripples were found as distributed all over the entire surface of the monofilament, and indeed, in the order of $4 - 20 \times 10^{7}$ per sq. cm.

As schematically shown at (III) and (IV) in FIG. 3, the bonds among the constituent monofilaments are not of the superficial nature, but of the substantially material-exchanging nature; thus, they are highly rigid and strong and extend each along a considerable axial length, which fact is believed to serve for the establishment of a non-twisted filaments bundle and for the creation of the claimed linen-like touch. As seen from the schematic illustration in FIG. 4, the lengthy interfilamentary bonds are generated at random, not only in the longitudinal direction, but also in the lateral direction of the multifilament. When practically observed, over 90% of the constituent monofilaments are bonded along a distance of 1 inch (2.54 cm) of the yarn. At least 80% of the bonds have each a length of at least 5 mm in the axial length of the yarn. A certain percentage of the bonds may represent point-like or shorter length of fused-together joins. On account of the provision of the aforementioned kind of rather dense-distributed, intimately established interfilamental bonds, the multifilament yarn processed in accordance with the present invention could not be dismantled into individual monofilaments, even when subjected to rather heavy outside mechanical forces as met during passage through a number of yarn guide means and caused by rather severe friction between the yarn and the guides. Although not specifically and intentionally twisted, the processed multifilament yarn is well durable against severe mechanical friction as may frequently met during usage as sewing machine yarn, as caused by sliding pressure contact of the yarn with wall of the needle hole or the sewing material. This satisfactory filaments-binding effect provided by the strong interfilamentary bonds will dispense with the otherwise unavoidable intentional yarn twisting.

In the following, the invention will be more fully and specifically described by reference to several preferred numerical examples.

EXAMPLE 1

Chips of nylon 6, having a relative viscosity of 0.3 relative to sulfuric acid were spun and stretched as conventionally into a multifilament of 70 d/24f. With use of a modified processing head shown in FIG. 5, wherein $\theta = 45°$; inner diameter at passage $k$ : 0.5 mm; length of passage $g$ or $g'$ being 20 mm, the multifilament material yarn was processed with steam under the following conditions:

| Sample No. | Temp., ° C | Treating period, seconds | Rate of Underfeed, % |
|---|---|---|---|
| A | 130 | 0.007 | 3.5 |
| B | 150 | 0.007 | 3.5 |
| C | 150 | 0.02 | 3.5 |
| D | 150 | 0.02 | −2.0 |
| E | No Processing | | |

Resulted properties of the processed multifilament yarn were as follows:

| Sample No. | Degree of Bulkiness | Bonded Conditions: Percentage of Bonded Monofilament per inch | Bonded Conditions: Length of Each Bond | Pressure Bending Rigidity; mg/100f. |
|---|---|---|---|---|
| A | 4.0 | 92% | 83% | 25 |
| B | 3.9 | 95% | 84% | 30 |
| C | 3.6 | 99% | 90% | 35 |
| D | 4.1 | — | — | — |
| E | 3.5 | 0 | 0 | 12 |

Figure 9:
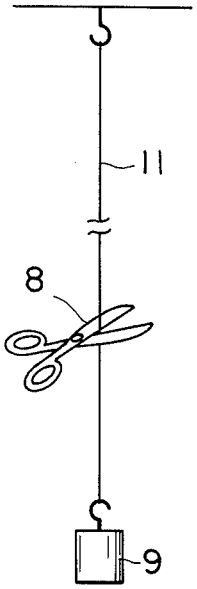
FIGS. 9 and 10 are schematic explanatory views for the illustration of a process for the measurement of splits.

The degree of bulkiness was measured as schematically illustrated in FIG. 9. In a hollow cylindrical vessel 41, having a closed end, the multifilament yarn, cut into lengths of 30 mm, only schematically shown in FIG. 9, was placed and loaded from upper with a load 10 of 10 g. The effective height or thickness of the thus loaded yarn cuts was measured and divided by the weight of the cut yarn.

The percentage of bonded monofilaments was determined by counting the number of such filaments carrying the fused bond(s) having at least 5 mm fused length, of the total.

Figure 12I:
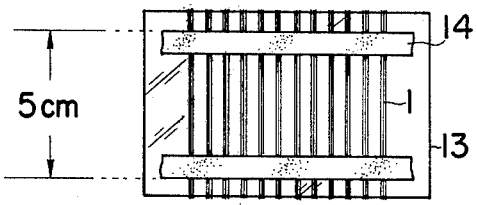
FIG. 12 represents several views for the illustration of the measurement of pressure bending rigidity of multifilament.
Figure 12:
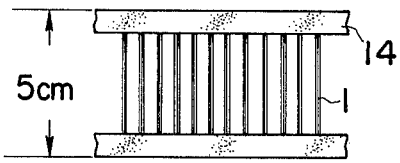

The pressure bending rigidity which may be called buckling rigidity was determined as schematically illustrated in FIG. 12. In this method, a celluloid plate 13, having at least a width of 5 cm, was taken and the processed multifilament yarn 1 was wound 200 turns therearound. Then, a pair of sticking tape strips were taken and stuck on the plate 13 in parallel to each other as shown at (1), FIG. 12, for positioning the thus wound yarn turns. Then, the excess parts of the wound yarn were cut off by a cutting knife, so as to remain the stuck-and-positioned main portion of the wound turns of the processed yarn 1, as shown at (II) of FIG. 12. The fixed yarn elements have a unified length of 5 cm, as shown. Then, these yarn elements kept substantially parallel to each other were longitudinally compressed by and between a pair of relatively movable pressurizing tools 15 and 16, so as to resiliently be fixed, and then, the axially urging force was measured as a measure for the determination of the required pressure bending rigidity. At (III), FIG. 12, the testing condition directly before application of the urging axial pressure is schematically illustrated. The thus measured value is generally given in the unit of mg/100f.

In the foregoing Table, the samples A, B and C correspond to the multifilament yarns according to this invention. These processed yarns represent linen-like touch, the degree of bulkiness being substantially unchanged when compared with that which had not been processed. In the case of the sample D, the underfeed rate was selected to - 2%, thus the yarn being kept in its loosened state during its processing stage. In this case, according to our experience, the processing step could not be continued successfully.

In the case of the samples A, B, C and E, when observed the bonded conditions, the bonds were found random, not only in the axial, but also in the lateral direction of the yarn, as shown only schematically in FIG. 4. More than 90% of the constituent monofilaments per inch (25.4 cm), were those bonded partially together. More than 80% of the bonds represented at least 5 mm length of fused connection.

The samples A and C represented filaments cross sections as shown at (III) and (IV) in FIG. 3, while the cross sections of samples D and E are shown schematically at (I) and (II) of FIG. 3.

The pressure bending resiliency of the thus processed multifilament yarn has a superior correspondency to the grade of interfilamentary bonding. As seen from the foregoing Table, there is a remarkable difference in the pressure bending rigidity between the processed yarn group: A, B and C and the representative non-processed yarn E. With higher processing temperature and/or with longer processing period, the rate of development of the thermal bonds will correspondingly be increased.

As a comparative experiment, we prepared crimped yarns in accordancce with the prior proposal disclosed in Example 5 of U.S. Pat. No. 3,251,181.

On the other hand, the processed yarns of 70 d/24 f, nylon 6, were gathered and formed into a tow of 70,000 d/24,000 f, which was then fed at a rate of 2 y.p.m. to the apparatus shown in FIG. 5 of said U.S. Pat. No. 3,251,181 in a flattened ribbon form. The processing was performed with use of steam, 288° C. In this way, a crimped yarn representing 21 crimps per inch was prepared. Degree of bulkiness amounted to 21.5; Rate of development of bonded monofilaments: 40%; Mean bonded length: 20%; Pressure bending rididity: 5 mg/100 f., which showed a substantial difference in various physical properties from the processed multifilament yarn according to this invention.

In the case of the foregoing crimped yarn, no strong and substantial thermal interfilamentary bonds could not be observed.

EXAMPLE 2

Chips of nylon 6, having a relative viscosity of 2.4 to sulfuric acid were spun and stretched as in the foregoing Example 1, to provide a multifilament yarn, 1260 d/204 f. This material yarn was processed with use of the processing head same as that which was used in the same foregoing Example 1, under the following processing conditions, to provide a similar yarn having strongly, substantially locally bonded constituent filaments.

| Sample No. | Temp., ° C | Treating period, seconds | Rate of Underfeed, % |
|---|---|---|---|
| F | 140° C (steam) | 0.04 | 3.5 |
| G | 150° C (steam) | 0.01 | 8.0 |
| H | 160° C (steam) | 0.005 | 0.5 |
| I | 190° C (hot air) | 10 | 3.5 |
| J | 230° C (hot air) | 5 | 3.5 |
| K | 300° C (hot air) | 1 | 3.5 |

2

Resulted properties of the processed multifilament yarn were as follows:

| Sample No. | Degree of Bulkiness | Strength-Holding Rate, % | Yield, % | Bonded Conditions: Percentage of Bonded Monofilament per inch | Bonded Conditions: Length of Each Bond |
|---|---|---|---|---|---|
| F | 3.7 | 85 | 100 | 95 | 85 |
| G | 4.0 | 84 | 100 | 91 | 82 |
| H | 3.6 | 82 | 100 | 92 | 93 |
| I | 3.4 | 79 | 85 | 90 | 86 |
| J | 3.6 | 77 | 80 | 92 | 85 |
| K | 3.9 | 74 | 78 | 94 | 86 |

The strength holdng rate means that of the strength of the thermally processed and locally bonded yarn, relative to that of the spun and stretched multifilament material yarn.

The yield means the rate of the successfully wound-up yarn relative to a specified yarn quantity (1.5 kgs.) out of the processed yarn prepared from 100 kgs. of the stretched material yarn.

The troubles for the reduced yields were caused by melt breakages and yarn entanglement on the guide rollers.

EXAMPLE 3

Chips of nylon 6, having a relative viscosity of 2.3 to sulfuric acid were spun and stretched as in the foregoing Example 1, to provide a multifilament yarn. This material yarn was processed with use of the processing head same as was used in the same foregoing Example 1, under the following processing conditions, to provide a similar yarn having strongly, substantially locally bonded constituent filaments, as before.

| Sample No. | Temp., ° C | Treating period, seconds | Rate of Underfeed, % |
|---|---|---|---|
| A' | 130 | 0.007 | 3.5 |
| B' | 150 | 0.007 | 3.5 |
| C' | 150 | 0.02 | 3.5 |
| E' | No Processing | | |

Resulted properties of the processed multifilament yarn were as follows:

| Sample No. | Degree of Interfilamentary Linkages, positions | Yarn Surface Conditions: Number of Formed Fine Projections, radians/mm² | Yarn Surface Conditions: Mean Height of Fine Projections Developed |
|---|---|---|---|
| A' | 47 | 5 × 107 | $2.7 \times 10^{-5} - 10 \times 10^{-5}$ |
| B' | 51 | 14 × 107 | $5 \times 10^{-5} - 25 \times 10^{-5}$ |
| C' | 52 | 18 × 107 | $5 \times 10^{-5} - 15 \times 10^{-5}$ |
| E' | 45 | 1.5 × 107 | $1.2 \times 10^{-5} - 2.3 \times 10^{-5}$ |

The degree of interfilamentary linkages is meant by the number of filament crossings as observed microscopically per inch (2.54 cm). Each of these observed values is the mean of 10 similar samples.

The surface of the constituent monofilament, when observed through an electron microscope, x 20,000, was covered with fine ripple-like undulations as before, showing a dewaxied feeling.

There was substantially no difference in the interfilamentary cross-linkage between the material yarn and the thermally processed one. It was seen that during the heat-treatment with heated fluid, no twisting and no filamentary interlinkage were generated or applied. With increase of the processing temperature, the number and the mean height of generated undulations as observed on the electron microscope, increased substantially correspondingly. With increase of the processing period, however, the apexes of the undulations may become flattened so that the mean height of the ripples or crests may be subjected to reduction under occasions.

For comparison, the multifilament yarn referred to above, nylon 6 70 d/24 f, was interlaced under specific conditions as disclosed in Example 8 of Japanese Patent Publication No. 12,230/1961. Pneumatic pressure: 10 psig; Rate of overfeed: 2%; Tension: 4 g; Yarn feed speed: 450 m/min. The thus interlaced yarn showed over 5,000 filamentary crossings per meter and was substantially different from the processed multifilament yarn according to this invention.

EXAMPLE 4

Chips of nylon 66, relative viscosity 3.0 to sulfuric acid, were melt spun and stretched conventionally, to provide a multifilament yarn, 140 d/48f. This yarn was thermally processed through the processing head, shown in FIG. 5. $\theta = 45°$. The bore size at *k*: 0.6 mm. Length at *g* or *g'* : 50 mm. The heat-treating conditions were as follows:

| Sample No. | Temp., ° C | Treating period, seconds | Rate of Underfeed, % |
|---|---|---|---|
| L | 160 | 0.007 | 5 |
| M | 180 | 0.007 | 5 |
| N | 180 | 0.02 | 5 |

Various physical properties of the resulted multifilament yarn were as follows:

| Sample No. | Pressure Bending Regidity, mg/100 f | Degree of Interfilamentary Linkages, positions | Yield, % | Strength Holding Rate, % | Frictional Strength | Length of Cut Splits | Bonded Conditions: Percentage of Bonded Monofilament per inch | Bonded Conditions: Length of Each Bond |
|---|---|---|---|---|---|---|---|---|
| L | 31 | 46 | 100 | 83 | 0.32 | 12 | 93 | 85 |
| M | 40 | 49 | 100 | 80 | 0.54 | 7 | 97 | 90 |
| N | 43 | 48 | 100 | 81 | 0.75 | 4 | 99 | 92 |
| E | 15 | 45 | — | 100 | — | 100 | 0 | 0 |

Figure 10:
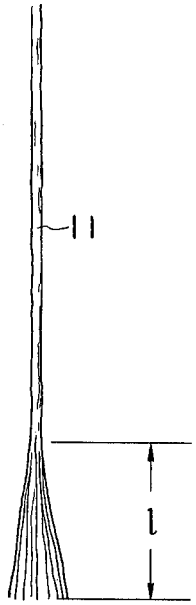
Figure 11:
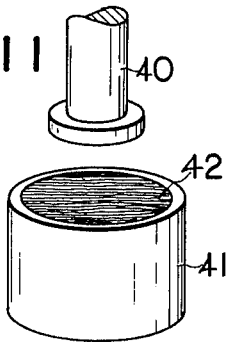
FIG. 11 is a perspective view of a process for the measurement of the bulkiness of a multifilament yarn.

The length of cut splits was measured in the manner as illustrated in FIGS. 9 and 10.

For this purpose, 1 m-length of the processed multifilament yarn 11 was suspended with a weight mass 9 at a load of 0.7 g/d. After lapse of 1 minute, the yarn 11 was cut by means of a pair of scissors 8 as shown in FIG. 9 at a height of 30 cm measured from the weight mass. Then, the length 1 of the yarn 11, see FIG. 10, along which the filaments became open, was measured in terms of millimeter.

Figure 13:
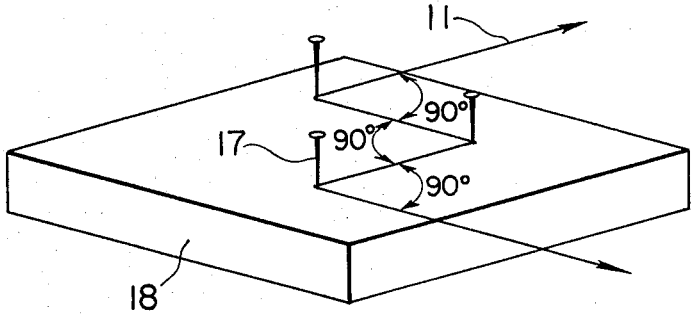
FIG. 13 is a perspective view for the illustration of measurement of the frictional strength of multifilament.

The frictional strength is a measure of the consistency of the yarn during frictional sliding movement thereof. The frictional strength was measured as schematically illustrated in FIG. 13.

Three pins 17 were driven into the material; of a rigid sheet 18 in a triangular arrangement as shown. The pin-to-pin distance was set to 2 – 5 cm. The yarn 11 was threaded and drawn so as to form alternately three successive 90° angles. The operator gripped by his hands at the both ends of a cut length of the yarn which was then slidingly drawn to-and-fro at a speed of one reciprocation per second and with a tensile load of about 0.5 g/denier. The cut splits length as measured in advance of this experiment was expressed by $\mathbf{l_0}$. Similar cut splits length after execution of 10 frictional reciprocations was denoted with $\mathbf{l_{10}}$. Then, the frictional strength may be expressed by the following formula:

$$\text{frictional strength} = \frac{l_0}{l_{10} - l_0}$$

As adjudged from the results tabulated in the above Table, both kinds of values: the cut splits length and the pressure bending rigidity correspond well the degree or amount of the thermal interfilamentary bonds. According to our experiments, the former value of a regularly sized multifilament yarn which is usable in the manufacture of textile fabrics amounts generally less than 50 mm.

When sample yarns L, M and N were used as sewing machine yarn in overlock service, no troubles were encountered. Smoothness and consistency of the yarn was found as highly superior for this service. Pressure bending rigidity was also within satisfactory range.

EXAMPLE 5

Stretched multifilament yarns, 70 d/24 f, of nylon 66, polypropylene and polyethylene terephthalate were thermally processed by use of a processing head substantially similar as that used in the foregoing Example 1, yet using heated air in place of heated steam.

The results were as follows:

| | Temp., °C | Treating period, seconds | Rate of Underfeed, % | Degree of Interfilamentary Linkages, positions | Pressure Bending rigidity, mg/100 f | Bonded Conditions: Precentage of Bonded Monofilament per inch | Bonded Conditions: Length of Each Bond |
|---|---|---|---|---|---|---|---|
| nylon-66 | 260 | 7 | 5 | 50 | 42 | 94 | 86 |
| polypropylene | 175 | 6 | 5 | 53 | 38 | 92 | 85 |
| polyethylene terephthalate | 275 | 3 | 5 | 55 | 40 | 91 | 81 |

EXAMPLE 6

Chips of nylon 6, having a relative viscosity 2.8 of sulfuric acid, were conventionally melt spun, so as to provide unstretched multifilament yarns. These yarns were steamingly processed under the following conditions:

| Sample No. | Temp., °C | Treating period, seconds | Rate of Underfeed, % |
|---|---|---|---|
| O | 130 | 0.007 | 3.5 |
| P | 150 | 0.007 | 3.5 |

-continued

| Sample No. | Temp., °C | Treating period, seconds | Rate of Underfeed, % |
|---|---|---|---|
| Q | 160 | 0.007 | 3.5 |

Physical properties of the thus processed and stretched yarns were as follows:

| Sample No. | Degree of Bulkiness | Pressure Bending Rigidity, mg/100 f | Length of Cut Splits | Bonded Conditions: Percentage of Bonded Monofilament per inch | Bonded Conditions: Length of Each Bond |
|---|---|---|---|---|---|
| O | 45 | 17 | 98 | 10 | 33 |
| P | 48 | 30 | 43 | 87 | 76 |
| Q | 46 | 40 | 12 | 93 | 84 |

The sample O represented substantially no consistency after the stretch step. Sample P showed no acceptable consistency. Only sample Q was acceptable

EXAMPLE 7

Chips of nylon 6, having a relative viscosity 2.8 to surfuric acid, were spun as conventionally to unstretched multifilament yarns of 735 d/34 f. These yarns were stretched in a stretching zone to 3.2 times and simultaneously processed with heated steam under same conditions as disclosed in the foregoing Example 6. These sample yarns are denoted O′, P′ and Q′, respectively. The resulted physical properties were as follows:

| Sample No. | Degree of Bulkiness | Range of Rates Strength Holding | Range of Length of Cut Splits | Bonded Conditions: Percentage of Bonded Monofilament per inch | Bonded Conditions: Length of Each Bond |
|---|---|---|---|---|---|
| O′ | 47 | 83–85 | 0–20 | 96 | 88 |
| P′ | 51 | 81–83 | 0–15 | 97 | 90 |
| Q′ | 52 | 82–83 | 0–11 | 98 | 91 |
| F | 49 | 81–87 | 0–43 | 95 | 85 |
| G | 53 | 81–86 | 0–37 | 91 | 82 |
| H | 60 | 80–86 | 0–25 | 92 | 93 |

The range of strength holding rates was determined by carrying out the experiments with $n = 10$ and by measurement of max. and min. values of strength holding rate. The range of cut splits length was similarly determined with $n = 10$. Results of samples F, G and H were same as those disclosed in the foregoing Example 2.

It will be certainly observed that no appreciable fluctuations are found in the resulted physical properties when the stretching and the thermal processing are carried out simultaneously.

The improvingly processed multifilament yarns thus obtained represented also a linen-like touch and could be utilized with superior effects in textile and other various industrial fields.

EXAMPLE 8

Chips of nylon 6, having a relative viscosity 3.0 to sulfuric acid were conventionally spun and stretched to yarns of 210 d/34 f. These yarns were thermally processed with use of three differently dimensioned processing heads I, II and III, having similar design features as illustrated in FIG. 2, yet representing somewhat different main dimensions as follows:

| | I | II | III |
|---|---|---|---|
| bore size at "d" | 1.0 m/m | 1.0 | 0.3 |
| minimum gap at "p" | 0.05 m/m | 1.2 | 5.0 |
| bore size at "al" | 3 m/m | 3.0 | 3.0 |

Fluid outlet flow rates were measured at the yarn inlet and the yarn outlet by attaching thereto respective flow meters. The resulted physical properties of the processed yarns were as follows:

| Processing Head | Flow Rate kgs/hr | | Degree of Bulkiness | Pressure Bending Rigidity, mg/100 f | Bonded Conditions | |
|---|---|---|---|---|---|---|
| | Yarn Inlet | Yarn Outlet | | | Percentage of Bonded Monofilament per inch | Length of Each Bond |
| I | −2 | 5 | 300 | 28 | 0 | 0 |
| II | 3 | 7 | 52 | 73 | 94 | 89 |
| III | 15 | 8 | 48 | 76 | 98 | 95 |

With the processing head I, processed steam was discharged exclusively through the yarn outlet opening, while air was sucked through the yarn inlet opening from open atmosphere. This unfavorable processing conditions are only schematically in FIG. 14. Although no reference symbols attached, these being same as used in FIG. 2, readers may well understand the situation when consulting with the foregoing description.

Figure 14:
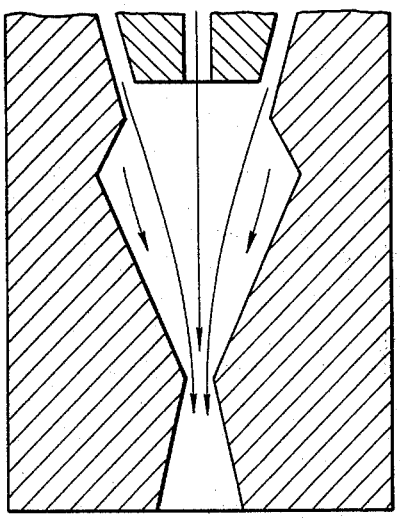
FIGS. 14 and 15 are respective axial sections of two different nozzle means employable in the invention.

In the case of FIG. 14, the processed steam is going out exclusively through the yarn inlet opening. In this case, it was found that no fluid flow collision space was established and maintained. It was ascertained that in this case, only too small amount of the processing steam was supplied to the chamber corresponding to *q* shown in FIG. 2, while the steam discharge velocity was relatively high for the formation of the desirous flow collision space. With use of such unfavorable processing head, no acceptable interfilamentary thermal bonds were observed to develop.

Figure 15:
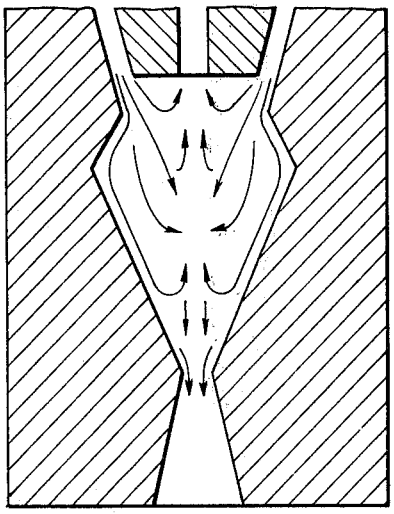

With use of the processing head II or III, a fluid compressing and flow collision space, similar as was referred to at *q* in FIG. 2, was created and maintained well in an acceptable degree. In this case, the processed steam was discharged through both the yarn inlet and outlet openings, as schematically illustrated in FIG. 15. In this case, the desired fluid-compressing and flow-collision space was effectively and successfully established and maintained. The processed results were also superior.

EXAMPLE 9

Chips of nylon 66, having a relative viscosity 3.2 to sulfuric acid, were melt spun and stretched, as conventionally, to multifilament yarns of 210 d/34 f. These yarns were thermally processed through respective processing heads IV, V and VI. Steam temperature: 180° C; Treating period: 0.05 second; Underfeed rate: 3.5%.

The head IV or V was of the similar design as was illustrated in FIG. 5. Main dimensions were:

| | IV | V |
|---|---|---|
| Bore Size at g or g' | 6 mm | 0.5 mm |
| Length at g or g' | 50 mm | 50 mm |

Head VI was same as the interlacer shown in FIG. 1 of Japanese Patent Publication 12230/1961. Bore size at the yarn passage: 1.3 mm. Length: 50 mm.

When comparing the processed properties of the multifilament yarn by use of heads IV and V, it was found that substantially equal results were obtained in these both cases.

With the head IV, however, the steam consumption was decreased to about ¼ to the case using the head V.

With the head VI, no effect and acceptable interfilamental bonds were practically obtained, and thus must be discarded. Consistency was poor.

Physical properties of the yarns thus processed with use of the foregoing processing heads IV, V and VI were as follows:

| Processing Head | Flow Rate, kgs/hr | | Pressure Bending Rigidity, mg/100 f. | Bonded Conditions | | Length of Cut Splits |
|---|---|---|---|---|---|---|
| | Yarn Inlet | Yarn Outlet | | Percentage of Bonded Monofilament per inch | Length of Each Bond | |
| IV | 12 | 12 | 81 | 99 | 98 | 11 |
| V | 3 | 3 | 80 | 97 | 95 | 13 |
| VI | 5 | 5 | 32 | 25 | 41 | 86 |

The cut splits length amounted to 86 mm as shown. This unfavorable value is substantially similar to that of about 90 mm which was obtained with yarns stretched before processing.

The embodiments of the invention in which an exclusive property or privilege is claimed are as follows:

1. A non-twisted multifilament yarn comprising a polyamide material wherein each of the monofilaments has over its overall peripheral surface a number of relatively evenly and densely distributed, ripple-like undulations, the number of undulations being in the range of from 4 to 20 X $10^{7}$ per square cm when observed through an electron microscope, the mean height of the surface undulations being in the range of $2.5 - 25 \times 10^{-5}$ mm, said monofilaments being thermally and locally bonded together at random in the longitudinal as well as lateral direction of the yarn, each of these thermal bonds extending substantially longer axially rather than laterally of the yarn, wherein over 90% of the constituent monofilaments represent linear interfilamentary local bonds per inch of the yarn, the linear length of each of over 80% of these bonds amounting to at least 5 mm, for providing necessary filament consistency without representing intentional interfilamental linkages of a non-torqued and non-bulked nature.

* * * * *